US009564717B2

(12) United States Patent
Whetstone et al.

(10) Patent No.: US 9,564,717 B2
(45) Date of Patent: Feb. 7, 2017

(54) CONNECTOR SYSTEM WITH CONNECTION SENSOR

(71) Applicant: Sabritec, Irvine, CA (US)

(72) Inventors: Gene Whetstone, Corona, CA (US); Richard Johannes, Trabuco Canyon, CA (US)

(73) Assignee: Sabritec, Costa Mesa, CA (US)

( * ) Notice: Subject to any disclaimer, the term of this patent is extended or adjusted under 35 U.S.C. 154(b) by 0 days.

(21) Appl. No.: 14/216,069

(22) Filed: Mar. 17, 2014

(65) Prior Publication Data

US 2014/0273608 A1 Sep. 18, 2014

Related U.S. Application Data

(60) Provisional application No. 61/798,360, filed on Mar. 15, 2013.

(51) Int. Cl.
*H01R 13/66* (2006.01)
*H01R 13/625* (2006.01)

(52) U.S. Cl.
CPC ..... *H01R 13/6683* (2013.01); *H01R 13/625* (2013.01)

(58) Field of Classification Search
USPC ..... 439/488, 39, 352, 498, 314, 318, 578
See application file for complete search history.

(56) References Cited

U.S. PATENT DOCUMENTS 5,113,467 A 5/1992 Peterson et al.
5,850,909 A * 12/1998 Wagner ..... 200/501
5,959,843 A * 9/1999 Kurrer ..... H05K 7/1409 200/292
6,081,169 A * 6/2000 Romerein et al. ..... 333/100
6,684,141 B2 * 1/2004 Koors ..... B60N 2/002 180/268

(Continued)

FOREIGN PATENT DOCUMENTS

EP 1625643 7/2010
JP 2005-267930 9/2005

OTHER PUBLICATIONS

Extended European Search Report for European Patent Application No. 14762927.3 dated Jun. 7, 2016; 15 pages.

*Primary Examiner* — Alexander Gilman
(74) *Attorney, Agent, or Firm* — Snell & Wilmer LLP

(57) ABSTRACT

A connector system including a sensing mechanism that can be used to control signal distribution through the connector system is disclosed. The connector system may include a first connector and a second connector configured to be operatively engaged in both a mated condition and an interlocked condition. The connectors of the connector system include conductive contacts that complete a conductive connection when the connectors are in the mated condition. The connector system includes a fastening mechanism that provides an interlocked condition following mating of the connectors, and may further include a sensor and a sensor trigger that may be used to sense the connection status of the system. The sensor may connected to a controller, with the controller controlling signal distribution through the connector system dependent on the connection status determined by the sensing mechanism. A method for controlling signal distribution through a connector system is also provided.

20 Claims, 6 Drawing Sheets

(56) References Cited

U.S. PATENT DOCUMENTS

| | | | | |
|---|---|---|---|---|
| 7,077,677 | B2 * | 7/2006 | Sanuki | H01R 13/623 439/315 |
| 8,497,753 | B2 * | 7/2013 | DiFonzo et al. | 335/205 |
| 8,562,368 | B2 * | 10/2013 | Boyer | 439/345 |
| 8,973,816 | B1 * | 3/2015 | Saini | 235/375 |
| 2003/0129870 | A1 | 7/2003 | Norwood et al. | |
| 2004/0036273 | A1 | 2/2004 | McClary | |
| 2006/0246771 | A1 | 11/2006 | Pepe et al. | |
| 2007/0059969 | A1 | 3/2007 | Shamoto | |
| 2007/0072442 | A1 | 3/2007 | DiFonzo et al. | |
| 2010/0087071 | A1 | 4/2010 | DiFonzo et al. | |
| 2011/0250785 | A1 * | 10/2011 | Reid | 439/488 |
| 2013/0017696 | A1 * | 1/2013 | Alvarez Rivera | 439/142 |

* cited by examiner

CONNECTOR SYSTEM WITH CONNECTION SENSOR

CLAIM OF PRIORITY UNDER 35 U.S.C. §119(e)

This application claims the benefit and priority of U.S. Provisional Patent Application No. 61/798,360, entitled "CONNECTOR SYSTEM WITH CONNECTION SENSOR," filed on Mar. 15, 2013, the entire contents and disclosures of which are hereby incorporated by reference herein.

BACKGROUND

1. Field

The present invention relates generally to connector systems and improvements thereto. More particularly, the present invention relates to connector systems configured with a sensing mechanism that can be used to control signal transmission through the connector.

2. Description of the Related Art

Connector systems such as electrical connectors are frequently required in a wide variety of systems to connect separate components for distribution of power and signal. For example, in certain applications, electrical connectors may be used for transmission of high current power or for distribution of signal to sensitive electronics systems. Likewise, connector systems may be required for use in extreme or dangerous environments, such as in underwater or explosive atmosphere applications. For these types of applications and environments, connector systems that include a connection sensor or switching mechanism configured to activate power or signal to the system only when the connector system is securely mated may be desirable for reasons of safety and system protection.

Connector systems having conductive contacts within the connector that complete a "loop back" circuit to a control unit have been used to control the transmission of power or signal through a mated pair electrical connector. However, this type of control system relies on connector system contacts, consuming conductive contacts and connector space and reducing the number of contacts available for distribution of power, data, and command and control signals through the connector system. Connector systems with other types of connection sensors are also known, but may rely on mechanical elements to operate a control switch in conjunction with mating or unmating of the connector system. Connection sensors with mechanical elements may suffer from decreased reliability over time and/or cycles of use or may be prone to failure due to environmental conditions.

For these reasons, a connector system including a connection sensor that does not rely on mechanical elements or other mechanisms sensitive to physical interference or mechanical failure is desirable.

SUMMARY

A connector system utilizing a solid-state sensor for detecting the connection or interlock status of the connector system and a method for controlling the distribution of signal through a connector system are disclosed.

A connector system is disclosed that includes a first connector and a second connector. Each connector includes one or more conductive contacts. The first connector and the second connector are configured to be operatively engaged in a mated condition that establishes a conductive connection between the conductive contacts. The connector system is further configured with a fastening system that provides for an interlocked condition of the connection system. A fastening system may include a bayonet-type fastening system, with the first and second connectors variously configured with complementary keys and keyways used to interlock the first and second connectors. The connector system may also include a sensing mechanism. The sensing mechanism may comprise a sensor and a sensor trigger, which may be used to sense the mated and/or interlocked conditions of the connection system. The sensor may be connected to a controller that can be used to control the distribution of signal through the connector system on the basis of a condition of the connector system reported by the sensor. The sensor can be a Hall effect sensor and the sensor trigger can be a magnet suitable for producing a magnetic field of sufficient strength to trigger the Hall effect sensor. Further, the Hall effect sensor can be configured to amplify one or more output voltage signals, and provide feedback to a controller for controlling signal distribution through the connector system.

Disclosed is a connector comprising a conductive contact, a receptacle shell having a mating end, at least one keyway in an outer surface of the receptacle shell, wherein the keyway is configured to receive a corresponding key of a corresponding connector, a sensor connected to a sensor lead termination, wherein the sensor is configured to generate one or more output signals triggered by a sensor trigger of the corresponding connector, and a sensor lead connected to the sensor lead termination, wherein the sensor lead is configured to communicate one or more of the output signal generated by the sensor to a controller. The sensor can be a Hall effect sensor and the sensor trigger can be a magnet suitable for producing a magnetic field of sufficient strength to trigger the Hall effect sensor. Further, the Hall effect sensor can be configured to amplify one or more output voltage signals, and provide feedback to a controller for controlling signal distribution through the connector system.

Also disclosed is a connector comprising, a conductive contact, a plug connector shell having a mating end, at least one key that is integral to the plug connector shell, and wherein the key is configured to operatively engage with a corresponding keyway of a corresponding connector, and a sensor trigger located within the key, wherein the sensor trigger is configured to trigger a sensor of the corresponding connector to generate one or more output signals. The sensor can be a Hall effect sensor and the sensor trigger can be a magnet suitable for producing a magnetic field of sufficient strength to trigger the Hall effect sensor. Further, the Hall effect sensor can be configured to amplify one or more output voltage signals, and provide feedback to a controller for controlling signal distribution through the connector system.

A method of controlling signal transmission through a connector system is also disclosed. A method may include the steps of mating a first connector and a second connector, locking the first connector and the second connector, detecting a configuration of the connector system, and controlling the distribution of signal between the first connector and the second connector. Mating the first connector and the second connector may include operatively engaging the connectors to establish a conductive connection between conductive contacts included in each connector. Locking the first connector and the second connector may include operating a fastening mechanism following mating of the connectors. Detecting a configuration of the connector system may include determining the mated and/or interlocked condition of the connector system using a sensing mechanism. Controlling distribution of signal between the first connector and the second connector may involve enabling or disabling transmission of signal through the connector system on the basis of the configuration of the connector system, as determined by the sensing mechanism.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Figure 1A:
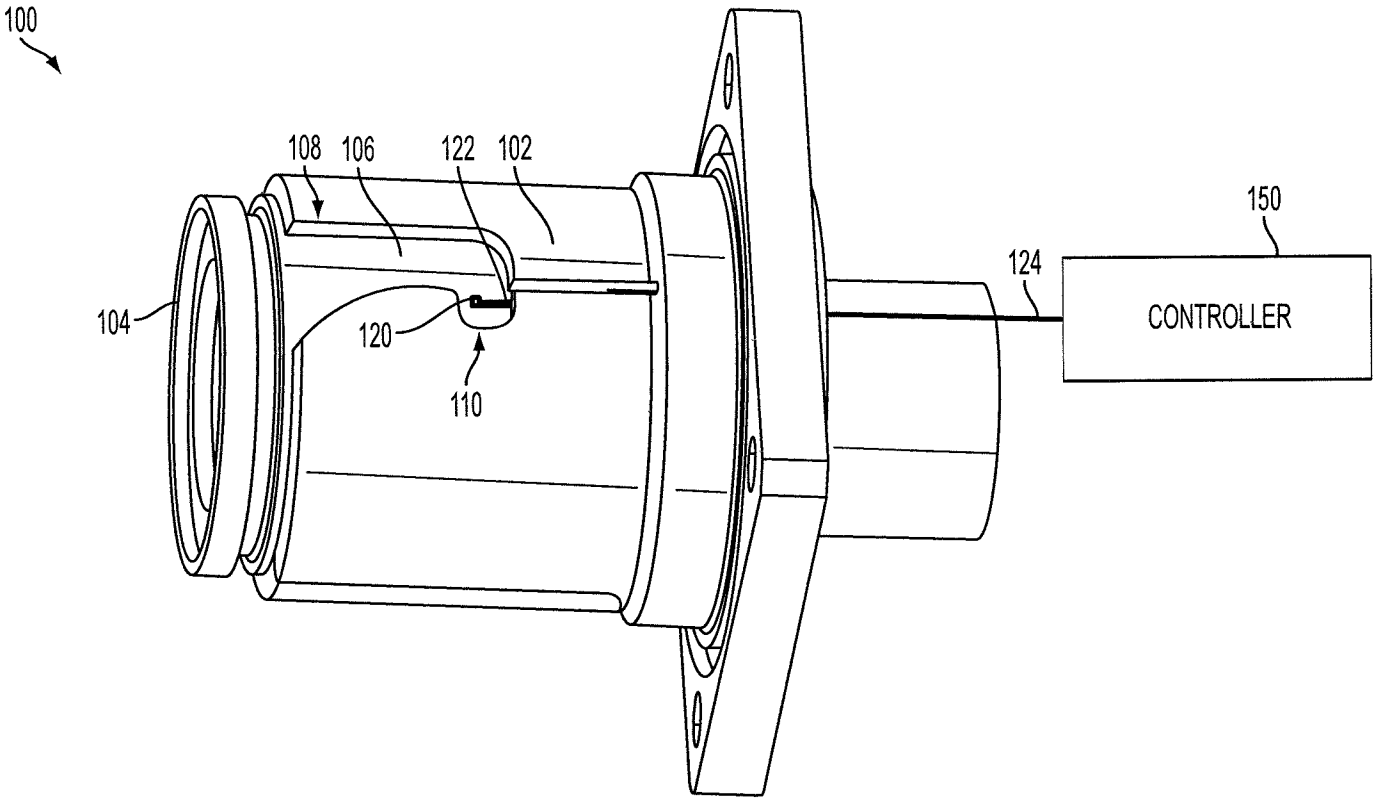
FIG. 1A is a perspective view of a receptacle assembly with a connection sensor according to an embodiment of the present invention.

Referring first to FIG. 1A, a perspective view of a receptacle assembly 100 of a connector system in accordance with various embodiments is shown. The receptacle assembly 100 has a receptacle shell 102 (e.g., a cylindrical receptacle shell) with a mating end 104. The mating end 104 of the receptacle assembly 100 is configured to receive and operatively engage a portion of a plug connector, such as the mating end 204 of the plug connector 200 of FIG. 2, described below. The mating end 104 of the receptacle assembly 100 may define a cavity that contains one or more conductive contacts of the receptacle assembly configured to complete a conductive connection with one or more corresponding conductive contacts of a plug connector.

A connector system in accordance with various embodiments may include a fastening mechanism that provides for two or more operatively engaged conditions of a connector system, such as a mated condition and an interlocked condition. The receptacle shell of a connector system may include components of a fastening mechanism. For example and as illustrated in FIG. 1A, receptacle assembly 100 includes components of a bayonet-type fastening mechanism with one or more keyways 106 in the outer surface of the receptacle shell 102 configured to receive a corresponding key (i.e., lug, post, pin, tab, or the like) of a corresponding plug connector, the keys and keyways 106 providing for a locking engagement of the connector system following mating of the connector system, as described in more detail below.

As used herein, the term "conductive connection" may include an electrically conductive connection between conductive contacts or an interface between optical fibers capable of transmitting an optical signal across the interface. Likewise, the term "conductive contact" may include not only a structure capable of providing an electrically conductive connection, but also components of an optical fiber interface, such as a fiber end face and surrounding ferrules or the like.

As used herein, the terms "locked" and "interlocked," along with other various forms thereof, may be used interchangeably to describe a condition of a connector system wherein an action by an operator other than and/or in addition to a pulling action (i.e., the reverse of an insertion action) is required to uncouple the connector system.

Each keyway of a receptacle assembly may be a channel, groove, slot, or the like, formed or machined in the receptacle shell with a depth, cross section, and configuration suitable to accept and provide for guidance and retention of a corresponding key of a plug connector. A keyway 106 may be a channel with a substantially square or rectangular cross section (i.e., the side walls of the channel are approximately perpendicular to the bottom of the channel) and a generally L-shaped configuration. The L-shape of the keyway 106 may comprise an axial segment 108 oriented substantially parallel to the longitudinal axis of the receptacle shell and a lock segment 110 oriented substantially perpendicular to (i.e., substantially parallel to the circumference of the receptacle shell) and intersecting with the axial segment 108. The keyway 106 may include an opening or entry at the mating end 104 of the receptacle assembly suitable for accepting a key of the corresponding plug connector and terminate at an end of the lock segment opposite the intersection with the axial segment.

In various embodiments, the cross-sectional dimensions of a keyway may vary along the length of the axial segment or the lock segment. Likewise, the configuration of a keyway may define curves to provide for ease of operation and/or enhanced locking of the bayonet fastening mechanism. For example, one or both side walls of a keyway 106 may be curved at the opening of the axial segment 108 near the mating end 104 of the receptacle to provide a wider cross section at the opening, thereby facilitating entry of the corresponding key of a plug connector during a mating process. Similarly, one or both side walls of a keyway may be curved at the intersection of the axial segment 108 and the lock segment 110 to encourage a change in direction of a key during a mating process. For example, the side wall of a keyway may be configured with a curve near the intersection of the axial segment and the lock segment. Such a curved configuration may facilitate a change in the direction of movement of an inserted key of a plug connector from an axial direction corresponding to insertion and mating (i.e., a first engaged condition) of the plug connector to a circumferential direction corresponding to rotation of the plug connector with respect to the receptacle. Rotation of the plug connector and entry of the key of the plug connector into the lock segment 110 of the keyway produces an interlocked configuration (i.e., a second engaged condition) of the connector system.

In various embodiments, a side wall of a keyway may also be curved or otherwise have a configuration in the lock segment 110 suitable to permit retrograde movement (i.e., movement in an axial direction opposite of the direction of insertion) of a key and the associated plug connector following entry of the key into the lock segment. Such a configuration may facilitate a more securely interlocked condition of a mated connector system, as described in greater detail below. For example, retrograde axial movement of an inserted key and associated plug connector following entry of the key into the lock segment of the keyway may prevent inadvertent rotation of a plug connector and disengagement of the mated connector system, since application of an axial force in the direction of insertion of the plug connector is required to reverse the retrograde movement provided for by the configuration of the lock segment 110 and to permit rotation of the key out of the lock segment and back into the axial segment 108. In various embodiments, a spring, resilient seal, or the like may be included in the receptacle or the plug connector to bias the mated pair of connectors in a retrograde direction when the mated pair of connectors is at or near the fully seated or mated position, thereby further enhancing the security of the locked position of the connector system.

In accordance with various embodiments, a bayonet-type fastening mechanism of a connector system may include two keyways and two corresponding keys. In such an embodiment, the keyways of a receptacle assembly may be configured on opposite sides of the receptacle shell. In other embodiments, a connector system fastening mechanism may include a single keyway and corresponding key. In still other embodiments, a connector system may include three or more keyways and corresponding keys.

In accordance with various other embodiments, configurations of a keyway other than the generally L-shaped keyway 106 illustrated in FIG. 1A are possible. For example, keyways configured with shapes having segments oriented at other angles relative to the axis or the circumference of the receptacle, or having cross sections other than those described above are within the scope of the present disclosure. Likewise, keyways having a configuration such as a spiral groove may also be used. Any of a variety of keyway configurations that may be used with a bayonet-style or other similar fastening mechanism will be well known to a person of ordinary skill in the art and are within the scope of the present disclosure.

A connector system in accordance with various embodiments also comprises a connection sensing mechanism. A connection sensing mechanism may include components associated with a receptacle and with a plug connector of a connection system. For example, and with reference now to FIG. 1B as well as to FIG. 1A, the receptacle assembly 100 may include a sensor 120 as a component of the connection sensing mechanism. In one embodiment, the sensor 120 may be a single sensor. In another embodiment, the sensor 120 may correspond to multiple sensors working in concert with one another. The sensor 120 may be embedded in the receptacle shell 102, with the sensor located, for example, beneath the lock segment 110 of the keyway 106. The sensor 120 includes a sensor lead termination 122 routed within the receptacle shell 102 and electrically connected to a sensor lead 124 configured to communicate output signals generated by the sensor 120 to a controller 150.

Figure 1B:
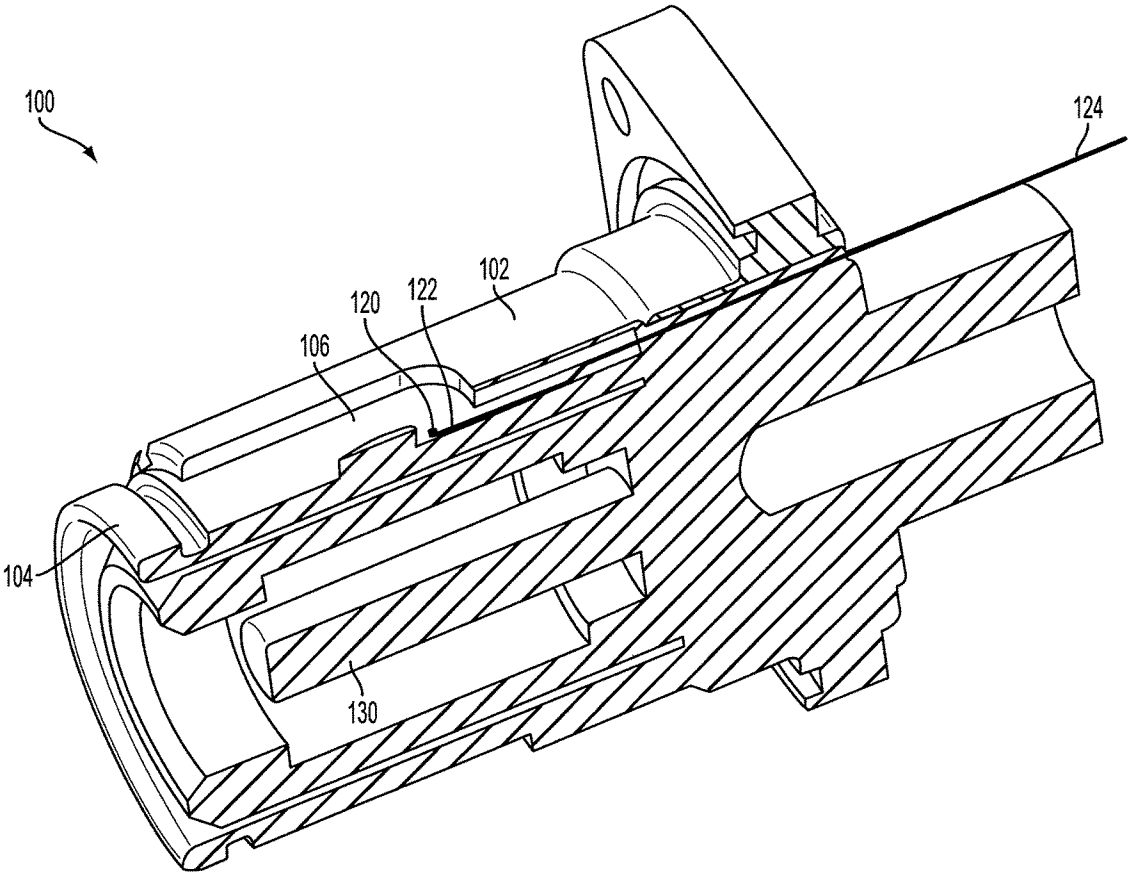
FIG. 1B is a cut-away side view of a receptacle assembly with a connection sensor according to an embodiment of the present invention.

In the exemplary embodiments of FIGS. 1A-1B, the sensor 120 is a Hall effect sensor. A Hall effect sensor is a transducer that varies its output voltage in response to a magnetic field. A Hall effect sensor can be made of a thin sheet of conductive or semi-conductive material. A Hall effect sensor operates in accordance with the Hall effect principle. The Hall effect principle is derived from knowing that when a current carrying conductor is placed in a magnetic field, a voltage differential will be generated perpendicular to the current and magnetic field. Alternatively, when no magnetic field is present, then the current is uniform and no voltage differential is generated. The voltage differential is the output voltage. Typically, a Hall effect sensor produces an output voltage of approximately 30 microvolts in the presence of 1 Gauss magnetic field. The magnetic field increases as the proximity between the Hall effect sensor and the sensor trigger decreases.

The present invention makes use of the Hall effect principle by locating a sensor trigger (e.g., sensor trigger 242), such as a magnet, in a fixed position of the plug connector 200, while the receptacle assembly 100 has a Hall effect sensor (e.g., sensor 120) located in a corresponding fixed position. The corresponding fixed positions are set at a pre-determined distance sufficient for the Hall effect sensor to detect a magnetic field caused by the magnet. As the distance between the Hall effect sensor and the magnet decreases, the strength of the magnetic field increases. Thus, as the connectors are mated and interlocked, the magnetic field interacts with the Hall effect sensor, thereby creating a voltage output. When the connectors are fully mated and locked, the Hall effect sensor transmits the output voltage to a controller 150.

Figure 5:
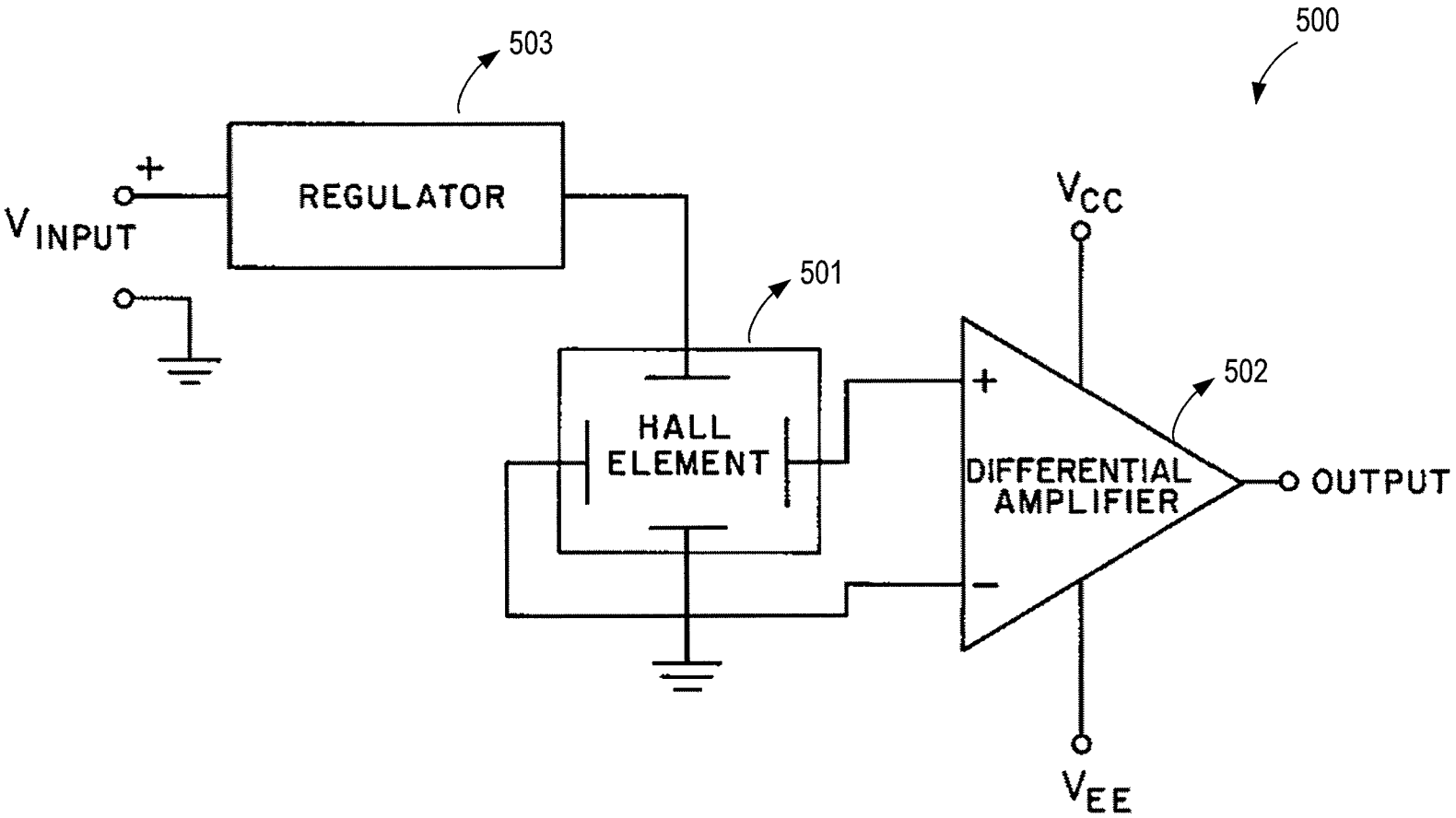
FIG. 5 is an exemplary embodiment of a circuitry contained within a Hall effect sensor according to an embodiment of the present invention.

Additionally, prior to the transmission of the output voltage to the controller 150, the Hall effect sensor can amplify the output voltage using circuitry contained within the Hall effect sensor. For example, FIG. 5 is an exemplary embodiment of a circuitry contained within a Hall effect sensor, and will be explained in greater detail below. The output voltage transmitted from the Hall effect sensor can also provide feedback to a controller 150 for controlling signal distribution, such as providing for an engage/disengage function to the power supply or signal transmission module.

A controller 150 may be any device or system suitable to enable distribution of power, data, command, and control signals through the fully mated and locked connector system. Likewise, a controller 150 may be configured to disable distribution of signals through the connector if the connector system is not in a mated and locked configuration suitable to trigger the sensor 120, as explained in greater detail below. In accordance with various embodiments, a connection sensor may include multiple sensor leads terminations connected to sensor leads, for example, three lead terminations connected to three leads providing power, ground, and output connections between the sensor and controller 150 and/or associated systems. Any of a variety of sensor lead configurations that may be used to connect a connection sensor to a controller 150 is within the scope of the present disclosure. The cut-away side view of the receptacle assembly 100 shown in FIG. 1B illustrates the relative position of the sensor, sensor lead termination(s), and sensor lead(s) of a connection sensing mechanism in a receptacle assembly in accordance with various embodiments. The conductive contact 130 of the receptacle assembly is also shown. The sensor 120 may be located at or below the surface of the receptacle shell 102 in the lock segment 110 of a keyway 106. For example, the sensor may be located flush with the surface of the receptacle shell, or, because a sensor such as a Hall effect sensor does not require a physical interface with the magnet or sensor trigger, the sensor 120 may be embedded or recessed in the receptacle shell such that the sensor is located beneath the surface of the receptacle shell in a manner that may provide for physical isolation of the sensor from contact with the external environment and/or the key of the plug connector while still permitting sensing of the magnet associated with the corresponding plug connector of the connector system. Likewise, the sensor lead termination(s) 122 and the sensor lead(s) 124 may be routed under or through or embedded within the receptacle shell 102 or a portion thereof.

In accordance with various embodiments, the location of the sensor 120 and routing of the sensor termination(s) 122 and sensor lead(s) 124 in the receptacle shell permits inclusion of a connection sensor in a receptacle assembly of a connector system in a configuration that is discrete and isolated from and/or robust against physical wear, environmental conditions, potentially interfering external contaminants, and other factors. These advantages, along with the lack of mechanical parts in sensor such as a solid state Hall effect sensor, may provide for an increased reliability of the connection sensing mechanisms of the connector system disclosed herein relative to other types of connection sensors such as reed switches, optical switches, mechanical switches, and the like. Furthermore, the location of the sensor and routing of the termination(s) and lead(s) in the receptacle shell permits inclusion of a connection sensor in a receptacle assembly and a connector system without consuming conductive contacts within the connector system. This feature may thereby increase the total number of contacts available for distribution of power, data, command and control signals through the connector system, or permit design and utilization of connector systems of a decreased size.

In accordance with various embodiments, a connector system includes a connection sensor that is configured to change a condition of the sensor dependent on the presence or absence of a sensor trigger in proximity to the sensor. The change of conditions may be, for example, a change of voltage output by a sensor such as the sensor 120. In various embodiments, a connection sensor of a receptacle assembly may be configured as a switch having a binary logic level. For example, in various embodiments, the sensor may be configured to be in an "off" condition, transmitting either no signal or a "disable" signal to a connected controller 150 in the absence of a sensor trigger or triggering magnetic field. The sensor may be configured to switch to an "on" condition or to transmit an "enable" signal to a connected controller 150 in the presence of a sensor trigger, for example, a magnet producing a sufficiently strong magnetic field and/or a magnetic field of the proper polarity.

In other embodiments, other types of magnetoresistive sensors may be used, such as a linear output magnetic field sensor capable of producing an output signal that is proportional to the strength of a magnetic field produced by a sensor trigger. In such embodiments, signal conditioning and/or processing electronics such as an analog-to-digital converter (ADC) may be used to process differential signal outputs from one or more sensors and translate output signals into signals used to control the transmission of signal through the connector system on the basis of its mated and interlocked status or other conditions. In still other embodiments, additional sensors or sensor arrays may be included in the connector system and used to sense the position of one or more magnets at various positions throughout an engagement path of one connector with respect to a second connector (i.e., the path traveled by a point on a connector relative to the complementary connector during a mating and locking process). In embodiments such as those described above, the sensor 120 or various other sensors may be configured to sense and output three or more conditions of a connector system, including, for example, unmated, partially mated, mated with a fault, fully mated but not interlocked, or fully mated and interlocked conditions.

Figure 2:
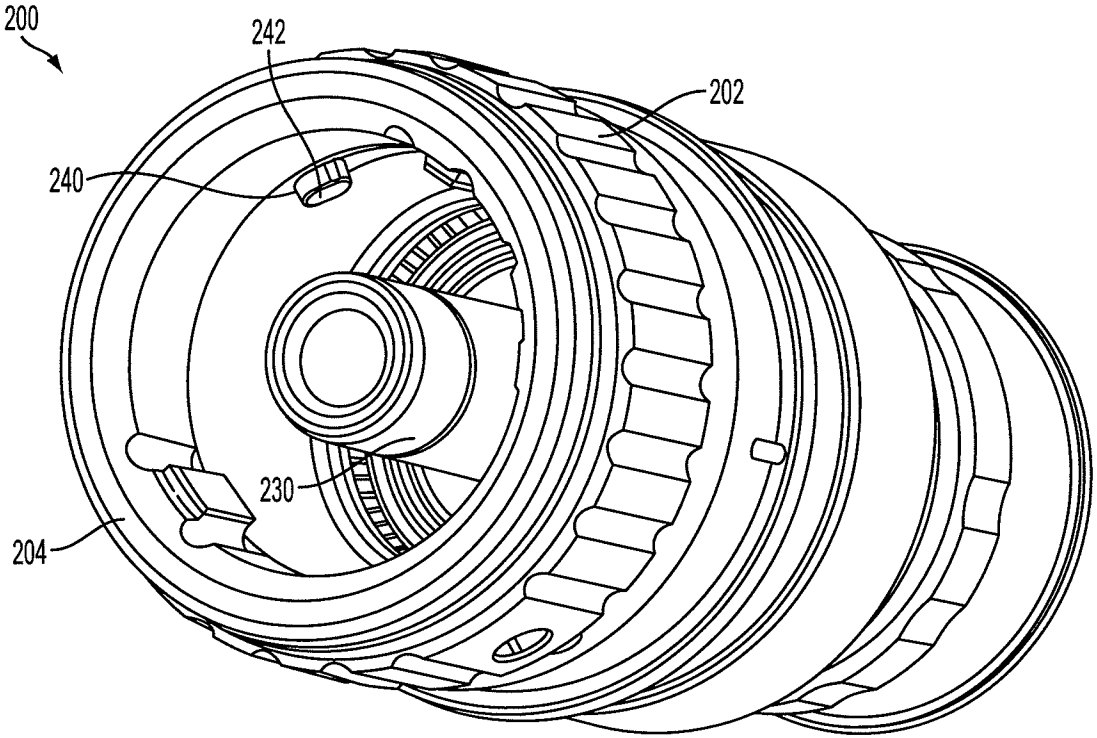
FIG. 2 is a perspective view of a plug connector with a connection sensor trigger according to embodiment of the present invention.

Referring now to FIG. 2, a perspective view of a plug connector in accordance with various embodiments including a connection sensor trigger component of a connection sensing mechanism is shown. A plug connector 200 may include a plug connector shell 202 with a mating end 204 configured to be insertably connected with the mating end of a corresponding receptacle assembly of the connector system, as described above. In accordance with various embodiments, the mating end 204 of the plug connector 200 may define a cavity for receiving and operationally engaging a mating end of a receptacle shell. A plug connector 200 may include one or more conductive contacts within the cavity of the mating end of the connector, such as the coaxial conductive contact 230 illustrated, that complete an electrically conductive connection with one or more conductive contacts of the receptacle assembly.

The cavity of the mating end 204 may further include one or more components of a fastening system such as the bayonet-type fastening mechanism described above. For example, the cavity of the mating end 204 of a plug connector may include one or more keys 240 configured to slide within and operatively engage a corresponding keyway of a receptacle assembly. A key 240 may further include a sensor trigger 242 located at or near the end of the key. In the exemplary embodiment of FIG. 2, the sensor trigger 242 is a magnet suitable for producing a magnetic field of sufficient strength to trigger switching of a sensor such as a Hall effect sensor (e.g., the sensor 120 of FIGS. 1A and 1B) of a receptacle assembly in accordance with various embodiments and as described above (e.g., the receptacle assembly 100 of FIGS. 1A and 1B) when the connector system is in a mated and locked condition and the key 240 is positioned in the lock segment of the keyway of the receptacle shell associated with the sensor.

Figure 3:
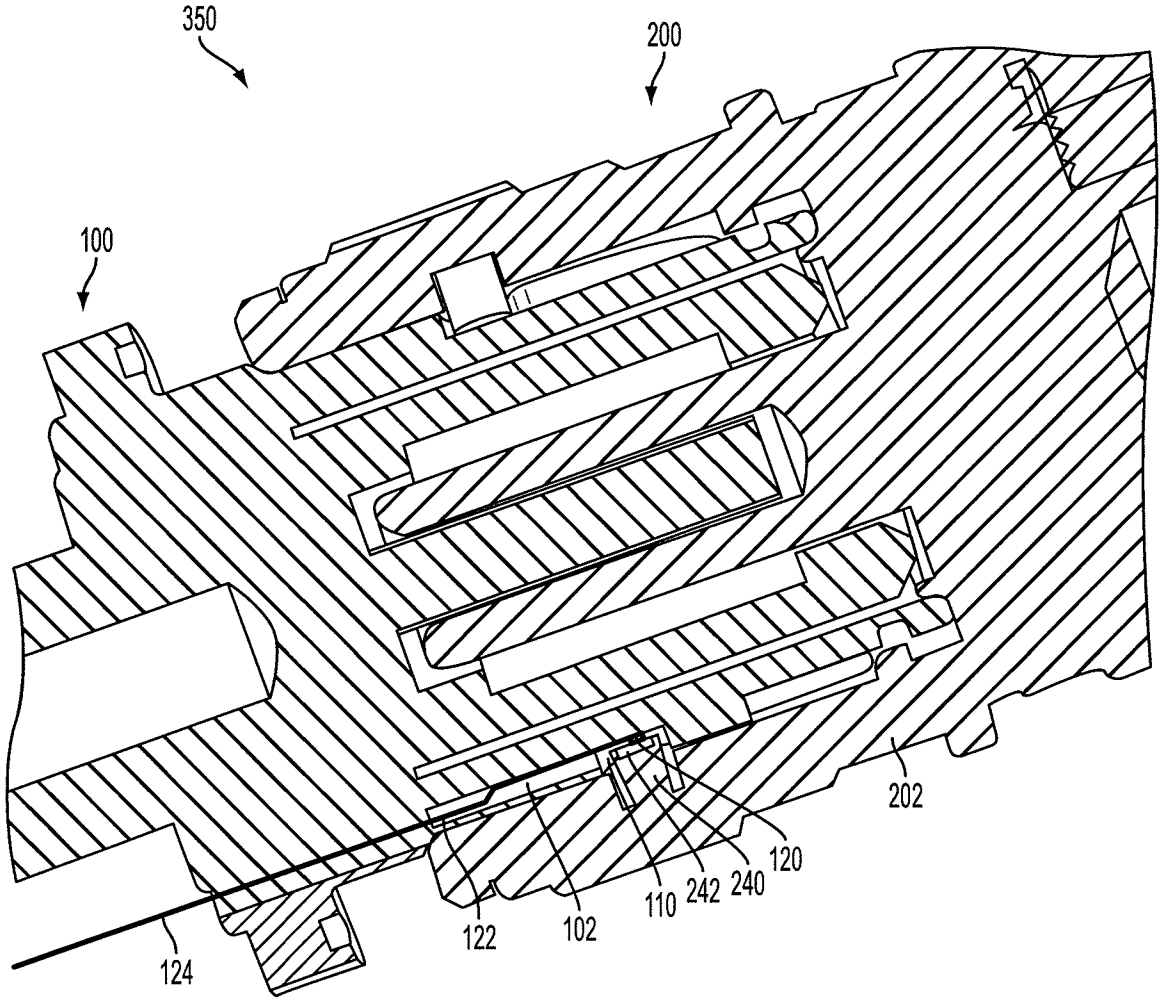
FIG. 3 is a magnified cut-away side view of a connector system with a receptacle assembly and a plug connector in a mated and interlocked configuration according to an embodiment of the present invention.

FIG. 3 illustrates a cut-away side view of a connector system 350 in accordance with various embodiments with the connector system in a mated and interlocked configuration. The illustrated connector system 350 includes a receptacle assembly 100 mated to a plug connector 200, embodiments of which have been previously described with respect to FIGS. 1A-2 and are illustrated in the mated and interlocked configuration to show the relative positions of the illustrated and described components of each. In accordance with various embodiments, the plug connector shell 202 of the plug connector 200 includes a key 240 that is integral to the shell. A sensor trigger 242 embedded in the end of the key 240 is positioned in proximity to sensor 120 embedded in the surface of the receptacle shell 102 of the receptacle assembly 100 at the lock segment 110 of the receptacle assembly keyway when the plug connector 200 is mated and interlocked with the receptacle assembly 100. The sensor 120 included in the receptacle assembly further includes sensor lead termination(s) 122 connected by sensor lead(s) 124 to a controller (not shown) suitable for controlling signal distribution through the mated and interlocked connector system 350.

Configuration of the mated pair of connectors of a connector system such that the magnet or sensor trigger in one connector of the pair is positioned to trigger the sensor only after the connectors have been mated and mechanically interlocked may serve as a fail-safe to prevent various possible hazards to operators and/or equipment such as arcing, shorting, shock, fire, explosion, or the like that may be associated with a process of completing certain types of circuits using a mated pair of connectors.

The key and keyway configurations of the various embodiments described herein are for purposes of illustration only; alternate configurations of keys and keyways between a plug connector and receptacle are possible in a bayonet-type fastening system and are within the scope of the present disclosure. For example, the keys of a bayonet-type fastening mechanism may be associated with the receptacle and the keyways associated with the plug connector. Likewise, the components of a connection sensing mechanism may be configured in various alternate arrangements, such as with a sensor located in a key and a sensor trigger in a keyway. In various other embodiments, a bayonet-type fastening mechanism may utilize components that are separate from the shell of a connector, such as a lock ring that abuts a portion of a receptacle shell or a plug connector shell.

Furthermore, fastening mechanisms or mechanical interlocks other than bayonet-type fastening mechanism illustrated and described may also be used. For example, a threaded-type fastening mechanism may be used. A threaded fastening mechanism may comprise a threaded lock ring or collar associated with a connector as a separate component that may be used to threadedly engage the corresponding connector of a connector system following mating of the connector system. In such an embodiment, the lock ring may include a magnet configured to be aligned with and to trigger a sensor associated with the receptacle assembly when the lock ring has been rotated to an interlocked position following mating of the connectors. In yet other embodiments, a sliding lock or a lock featuring an insertable key or other separate component may be used. Any type of fastening mechanism that provides for operative engagement of a connector system with distinct mated and interlocked conditions that can be distinguished by a sensing mechanism is within the scope of the present disclosure.

Similarly, the cylindrically shaped connector shells described and illustrated herein are intended merely for illustrative purposes. Connector systems including connectors having shells or bodies with various other shapes, such as ovoid, square, rectangular, or various other irregular or non-geometric cross sections may also be used. An ability to rotate a body or shell of a first connector with respect to that of a second connector is not required to provide for interlocking of the connectors in the connector system, since any of a variety of locking or fastening mechanisms may be included in a connector as separate components that may rotate or otherwise provide for a movement and/or a change of condition of a connector system from a mated or first engaged condition to a interlocked or second engaged condition.

Furthermore, although the components of a sensor mechanism have been described and illustrated as being variously included as part of both the first connector and the second connector of a connector system, in accordance with various embodiments, both the sensor and the sensor trigger may be included within one or the other of the first connector or the second connector. For example, a connector may comprise a portion of a fastening mechanism, wherein the portion of the fastening mechanism includes both the sensor and the sensor trigger, and wherein the portion of the fastening mechanism is only operable when a complementary portion of the fastening mechanism located on the second connector is appropriately positioned. In such an example, the entire sensor mechanism is associated with one connector of a connector system; however, the sensor mechanism can only be operated to signal a controller to enable signal distribution when the complementary second connector has been properly mated with the first connector. In the exemplary embodiment of FIG. 3, connector system 350 includes a Hall effect sensor, such as sensor 120, and sensor trigger, such as sensor trigger 242, which is a magnet suitable for producing a magnetic field of sufficient strength to trigger switching of the Hall effect sensor.

In accordance with various embodiments, a method of controlling transmission or distribution of a signal through a connector system is also provided. In various embodiments, controlling transmission of a signal through a connector system may include the steps of mating a first connector with a second connector, locking the first connector to the second connector, detecting a locked condition of the connector system, and controlling distribution of signal between the first connector conductive contact and the second connector conductive contact. Controlling distribution of signal between the first connector conductive contact and the second connector conductive contact may be dependent on detection of a locked or other condition of the connector system.

The connector system in which distribution of signal is controlled may comprise a first connector and the second connector and include a connection sensing mechanism. For example, a first connector may be a receptacle assembly such as the receptacle assembly 100 described and illustrated with respect to FIGS. 1A and 1B. Likewise, a second connector may be a plug connector such as plug connector 200 described and illustrated with respect to FIG. 2.

In accordance with various embodiments, a method of controlling transmission of signal through a connector system includes a step of mating a first connector and a second connector. Mating the connectors establishes a conductive connection between a first connector conductive contact and a second connector conductive contact, such as the conductive contact 130 of a receptacle assembly 100 and the conductive contact 230 of a plug connector 200.

Figure 4:
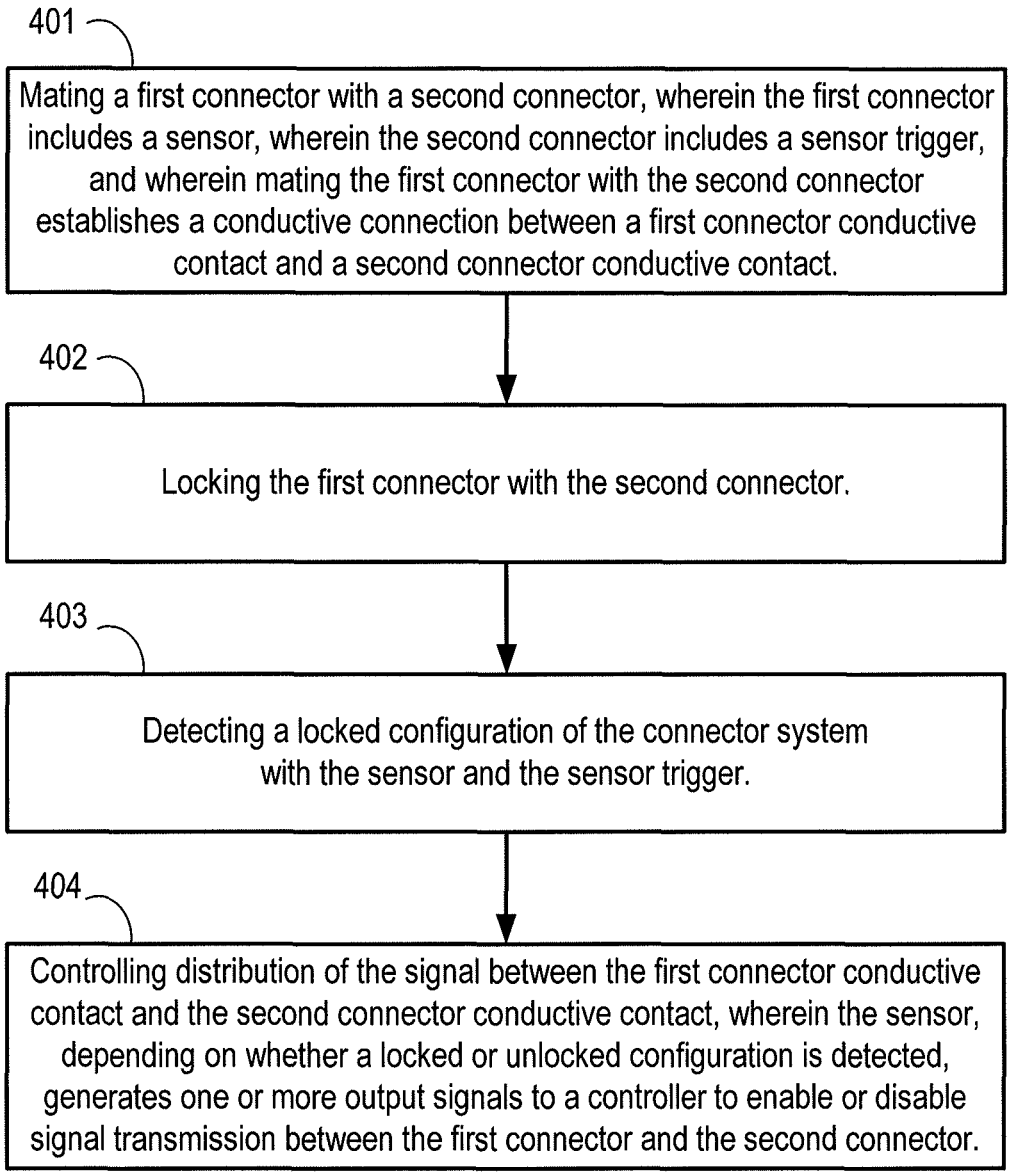
FIG. 4 is a flowchart depicting a method for controlling signal distribution through a connector system according to an exemplary embodiment of the present invention.

FIG. 4 is a flowchart depicting a method for controlling signal distribution through a connector system according to an exemplary embodiment of the present invention. At step 401, a first connector, such as receptacle assembly 100, is mated with a second connector, such as plug connector 200. The first connector includes a sensor, such as sensor 120. The second connector includes a sensor trigger, such as sensor trigger 242. As discussed, sensor 120 is a Hall effect sensor and sensor trigger 242 is magnet suitable for producing a magnetic field of sufficient strength to trigger switching of the Hall effect sensor.

In various embodiments, mating a first connector and a second connector comprises a first movement of the first connector and the second connector with respect to one another, such as a movement in a first direction. For example, mating of a plug connector 200 with a receptacle assembly 100 comprises a movement of the plug connector 200 in an axial direction with respect to the receptacle assembly 100 that provides for insertion and operational engagement of the plug connector with the receptacle assembly. During insertion and mating of the plug connector 200 with the receptacle assembly 100, a key 240 of the plug connector may enter the axial segment 108 of a corresponding keyway 106 of the receptacle assembly and slide along the axial segment of the keyway until the plug connector reaches a fully seated or mated position. In accordance with various embodiments, insertional movement of the plug connector relative to the receptacle assembly such that key reaches the intersection of the axial segment 108 and the lock segment 110 results in a mated condition of the connection system such that a conductive connection is established between the conductive contacts 130 and 230 of the receptacle assembly and plug connector, respectively. In various other embodiments, movements of connectors in directions other than axial movement may be used to mate a first connector to a second connector. For example, mating a first connector with a second connector may require movement in both an axial direction and a rotational direction simultaneously. In still other embodiments, mating may require a series of movements. Any movement or combination of movements that may be used to mate a first connector with a second connector is within the scope of the present invention and may comprise a "first movement" of the first connector and the second connector with respect to one another, as used herein.

At step 402, following mating of a first connector and a second connector, a method of controlling signal distribution through a connector system comprises locking the first connector with the second connector. In various embodiments, locking a first connector and a second connector of a connector system requires a second movement of the connectors with respect to one another. A second movement of the connectors may include a movement in the same direction as the first movement, as described above, and comprise, for example, an extension of the first movement to a point beyond the first (i.e., mated) condition provided by the first movement. Alternatively, a second movement may include a movement that is in a second direction that is a different direction from that of the first movement. For example, a second movement of the connectors may be a rotational or torsional movement of a plug connector 200 with respect to a receptacle assembly 100 following mating of the connectors. During such a rotational movement, a key 240 of the plug connector enters the lock segment 110 of the keyway 106, with the key of the plug connector engaging a wall of the lock segment of the keyway, thereby providing for axial retention or locking of the mated pair of connectors. In accordance with various other embodiments, locking the first connector and the second connector may comprise a movement of a component of one of the connectors with respect to the other connector, rather than a movement the shell or body of one of the connectors with respect to the other.

At step 403, a method of controlling signal distribution through a connector system includes detecting a locked configuration of a connector system. Detection of the locked configuration may be performed using a connection sensing mechanism. A connection sensing mechanism may include any means by which the physical or operational engagement status and/or interlocked status of a connector system can be detected. In various embodiments, detection of a locked configuration may be performed using a connection sensing mechanism that includes a connection sensor and a sensor trigger such as the sensor 120 and sensor trigger 242 illustrated and described above with respect to FIGS. 1A-3. As previously described, detection of a locked configuration of a connector system or various other possible conditions of a connector system may produce a change in the state of a sensor such as the sensor 120 based on the proximity of a suitably configured sensor trigger 242, and the change in state of the sensor may be communicated to a controller associated with the connector system. For example, when the sensor detects a locked configuration, then the sensor generates one or more output signals to a controller to enable signal transmission between the first connector and the second connector. Alternatively, if the sensor does not detect a locked configuration, then the sensor generates one or more output signals to a controller to disable signal transmission between the first connector and the second connector.

At step 404, a method of controlling signal distribution through a connector system includes controlling the distribution of signal between a conductive contact of the first connector and a conductive contact of the second connector, such as conductive contacts 130 and 230 of receptacle assembly 100 and plug connector 200, respectively. As used herein, "signal" can include any form of electrical voltage or current, including that used for transmission or distribution of power, data, or command and control signals. Signal can also include optical transmissions as well as any other type of medium that might be transferred, transmitted, or communicated using a connector system. In various embodiments, controlling distribution of signal between the conductive contacts of a connector system may be dependent on the state of a sensor 120 as affected by the position of a sensor trigger 242, with the relationship between the sensor 120 and the sensor trigger 242 determined by the mated and/or interlocked condition of connection system, as described above. In accordance with various embodiments, controlling distribution of signal between the conductive contacts of a connector system may comprise a binary set of conditions, with transmission of signal through the connector system being either enabled or disabled. For example, when the sensor detects a locked configuration, then the sensor generates one or more output signals to a controller to enable signal transmission between the first connector and the second connector. Alternatively, if the sensor does not detect a locked configuration, then the sensor generates one or more output signals to a controller to disable signal transmission between the first connector and the second connector.

In other embodiments, controlling transmission of signal through a connector system may further comprise reporting the status or condition of the connector system, such as reporting a disengaged connector system, a partially engaged connector system, a faulty engagement, or the like. Any level of operation of a connector system, as well as any reporting of one or more conditions of a connector system that may be detected using various connection sensing mechanisms such as those described herein, are within the scope of controlling distribution of signal through a connector system.

FIG. 5 is an exemplary embodiment of a circuitry contained within a Hall effect sensor. The Hall effect sensor, such as sensor 120, can be configured to amplify its output voltage and provide feedback to a controller for controlling signal distribution using circuitry contained within it, such as the exemplary embodiment of circuitry 500 in FIG. 5. Circuit 500 comprises a Hall element 501, a differential amplifier 502, and a regulator 503. Hall element 501 is a Hall effect sensor, such as sensor 120. Differential amplifier 502 amplifies the output voltage generated by Hall element 501. As discussed, a Hall effect sensor typically produces an output voltage of approximately 30 microvolts in the presence of 1 Gauss magnetic field. Thus, the output voltage of approximately 30 microvolts can be amplified using differential amplifier 502. The output voltage is then transferred to a controller for controlling signal distribution via sensor lead(s), such as sensor lead(s) 124. Regulator 503 holds the input current constant so that the Hall element 501 only senses the intensity of the input magnetic field produced by the sensor trigger, such as sensor trigger 242. Holding the input current constant is important because the output voltage generated by Hall element 501 is proportional to the vector cross produce of the input current and the input magnetic field.

Although the embodiments illustrated herein have shown various connector system components as integrated with or coupled to a receptacle assembly or a plug connector, the gender of each may be reversed and/or certain features of the plug connector may be incorporated into the receptacle assembly and vice versa in accordance with various alternative embodiments. Likewise, various alternative embodiments may also utilize greater or fewer connector components relative to what has been described with respect to the illustrated embodiments. For example, the connector system may include multiple conductive pins and sockets, or may include a fasting system with a lock ring component that rotates independently of the connector shells or bodies.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A connector system comprising:

a first connector having a first conductive contact, a first housing configured to house the first conductive contact, and a first shell formed integrally with the first housing and having a groove defining a keyway;

a second connector having a second conductive contact, a second housing configured to house the second conductive contact, and a second shell formed integrally with the second housing and having a key configured to be received by the keyway, the first shell and the second shell overlapping to form a cavity when the key is received by the keyway, wherein the first connector and the second connector are configured to be operatively engaged in a mated unlocked condition or a mated locked condition while the key is received by the keyway, the first conductive contact and the second conductive contact being in electrical communication within the cavity when the first connector and the second connector are in either of the mated unlocked condition or the mated locked condition;

a controller configured to enable signal communication through the first conductive contact and the second conductive contact based on receiving an enabling signal, and disable signal communication through the first conductive contact and the second conductive contact based on receiving a disabling signal;

a sensor trigger proximate to at least one of the keyway or the key; and a sensor proximate to the other of the key or the keyway and connected to the controller, wherein the sensor is configured to:

transmit the enabling signal to the controller when the first connector and the second connector are in the mated locked condition, and transmit the disabling signal to the controller when the first connector and the second connector are in the mated unlocked condition or the unmated unlocked condition.

2. The connector system of claim 1, wherein the sensor is a Hall effect sensor.

3. The connector system of claim 2, wherein the sensor trigger is a magnet suitable for producing a magnetic field of sufficient strength to trigger the Hall effect sensor to generate one or more output signals including the enabling signal or the disabling signal.

4. The connector system of claim 2, wherein the Hall effect sensor is configured to amplify at least one output signal.

5. The connector system of claim 2, wherein the Hall effect sensor is configured to provide feedback to the controller for controlling signal communication through the first conductive contact and the second conductive contact based on whether the first connector and the second connector are in the mated unlocked condition, the mated locked condition or the unmated unlocked condition.

6. The connector system of claim 1, wherein operative engagement of the first connector and the second connector produces the mated unlocked condition before the mated locked condition.

7. The connector system of claim 1, wherein the sensor is further configured to detect three or more conditions of the first connector and the second connector including whether the first connector and the second connector are in the mated locked condition, the mated unlocked condition or the unmated unlocked condition based on a location of the sensor relative to the sensor trigger.

8. A connector comprising:

a conductive contact;

a housing configured to house the conductive contact;

a receptacle shell formed integrally with the housing, having a mating end, and having a groove defining at least one keyway configured to receive a corresponding key of a corresponding connector, the receptacle shell and a corresponding shell of the corresponding connector overlapping to form a cavity when the connector and the corresponding connector are in a mated condition, and the conductive contact being in electrical communication with a corresponding conductive contact of the corresponding connector within the cavity;

a sensor positioned adjacent to the at least one keyway, connected to a sensor lead termination and configured to generate one or more output signals that indicate three or more conditions of the connector and the corresponding connector based on a location of the sensor relative to a sensor trigger of the corresponding connector, the one or more output signals including a disabling signal for disabling signal communication through the conductive contact; and a sensor lead connected to the sensor lead termination and configured to transmit at least one of the one or more output signals.

9. The connector of claim 8, wherein the sensor is a Hall effect sensor.

10. The connector of claim 9, wherein the Hall effect sensor is configured to amplify at least one of the one or more output signals prior to transmission.

11. The connector of claim 9, wherein the Hall effect sensor is configured to transmit the one or more output signals to a controller for controlling signal communication between the connector and the corresponding connector based on the one or more output signals.

12. The connector of claim 8, wherein the sensor is recessed in the receptacle shell, the receptacle shell includes an outer surface such that the sensor is located beneath the outer surface of the receptacle shell, and the sensor lead termination is routed within the receptacle shell.

13. The connector of claim 8, wherein the receptacle shell has a longitudinal axis and the keyway comprises:

an axial segment oriented substantially parallel to the longitudinal axis of the receptacle shell; and a lock segment oriented substantially perpendicular to and intersecting with the axial segment.

14. A connector comprising:

a conductive contact;

a housing configured to house the conductive contact;

a plug connector shell formed integrally with the housing, having a mating end, and having at least one key configured to operatively engage with a corresponding keyway of a corresponding connector, the plug connector shell and a corresponding shell of the corresponding connector overlapping to form a cavity when the connector and the corresponding connector are in a mated condition, and the conductive contact being in electrical communication with a corresponding conductive contact of the corresponding connector within the cavity; and a sensor trigger located within the key and configured to trigger a sensor of the corresponding connector to generate one or more output signals that indicate three or more conditions of the connector and the corresponding connector based on a location of the sensor trigger relative to the sensor, the one or more output signals including an enabling signal for enabling signal communication through the conductive contact.

15. The connector of claim 14, wherein the sensor is a Hall effect sensor and the sensor trigger is a magnet suitable for producing a magnetic field of sufficient strength to trigger the Hall effect sensor to generate one or more output signals.

16. A method of controlling signal distribution through a connector system, comprising the steps of:

mating a first connector having a first conductive contact, a first housing configured to house the first conductive contact, a first shell formed integrally with the first housing, a key or a keyway, and a sensor positioned proximate to the key or the keyway, with a second connector having a second conductive contact, a second housing configured to house the second conductive contact, a second shell formed integrally with the second housing, the other of the key or the keyway, and a sensor trigger positioned proximate to the other of the key or the keyway, the mating establishing, within a cavity formed by an overlapping of the first shell and the second shell, a conductive connection between the first conductive contact and the second conductive contact in a mated unlocked condition;

locking the first connector and the second connector together in a locked condition;

detecting, by the sensor, the mated locked condition based on a location of the sensor relative to the sensor trigger; and enabling, by a controller, signal communication between the first connector and the second connector based on when the first connector and the second connector are engaged in the mated locked condition.

17. The method of claim 16, wherein mating the first connector with the second connector comprises a first movement of the first connector relative to the second connector and locking the first connector and the second connector together comprises a second movement of the first connector relative to the second connector, and wherein the second movement is in a direction different from that of the first movement.

18. The method of claim 16, further comprising generating, by the sensor, one or more output signals to be received by the controller, wherein the enabling by the controller, of signal communication between the first connector and the second connector is in response to receiving the one or more output signals.

19. The method of claim 16, further comprising generating, by the sensor, one or more output signals to be received by the controller and disabling, by the controller, signal communication between the first connector and the second connector in response to receiving the one or more output signals.

20. The method of claim 16, wherein the sensor is a Hall effect sensor, and wherein the sensor trigger is a magnet suitable for producing a magnetic field of sufficient strength to trigger the Hall effect sensor to generate one or more output signals.

* * * * *